US005799823A

United States Patent [19]

Feltrin

[11] Patent Number: 5,799,823

[45] Date of Patent: Sep. 1, 1998

[54] DEVICE FOR RELEASING THE PRODUCTS IN A VENDING MACHINE

[75] Inventor: Antonio Feltrin, Castelletto Monferrato, Italy

[73] Assignee: Vendo Italy S.p.A., Italy

[21] Appl. No.: 732,397

[22] PCT Filed: Apr. 26, 1995

[86] PCT No.: PCT/IT95/00059

§ 371 Date: Oct. 28, 1996

§ 102(e) Date: Oct. 28, 1996

[87] PCT Pub. No.: WO95/30213

PCT Pub. Date: Nov. 9, 1995

[30] Foreign Application Priority Data

Apr. 28, 1994 [IT] Italy ..... MI94A0814

[51] Int. Cl.[6] ..... G07F 11/00

[52] U.S. Cl. ..... 221/298; 221/289; 221/67; 221/266; 221/242

[58] Field of Search ..... 221/298, 67, 289, 221/266, 242, 112, 116

[56] References Cited

U.S. PATENT DOCUMENTS 3,203,588 8/1965 O'Neal ..... 221/298

*Primary Examiner*—William E. Terrell
*Assistant Examiner*—Khoi H. Tran
*Attorney, Agent, or Firm*—Londa and Traub LLP

[57] ABSTRACT

A device for releasing the products in a vending machine includes a structure for containing the stack of products consisting in a front plate (1) and a rear plate (2) to which two flanks (3*a*, 3*b*) and two walls (4*a*, 4*b*) are secured, a pair of rocker levers (5*a*, 5*b*) and a revolving basket (6) being rotatably mounted inside structure for alternately supporting the two staggered columns forming the stack of products and for releasing the products. The driving components, which impart a unidirectional revolving motion to the basket (6), and the controlling components of the rockers (5*a*, 5*b*), which consist in a pair of cams (14) which rotate at half the revolving speed of the basket (6), are positioned outside said structure.

5 Claims, 3 Drawing Sheets

DEVICE FOR RELEASING THE PRODUCTS IN A VENDING MACHINE

The present invention relates to the mechanisms included in vending machines, and in particular to a device for releasing the products.

It is known that vending machines for products packed in envelopes having the shape of a surface of revolution, such as typically cans and bottles of drinks, usually include a basket located below the stack of products and suitable to control the release thereof. In order to exploit at the best the available width, this stack is generally made up of two columns of products placed side by side and staggered, so that by supporting one of them also the other one is supported. The released product comes alternately from the left column and from the right one.

The release is carried out through a rotation of about 90°, e.g. counter clockwise, of the basket which moves to a vertical position whereby the products rolls down from the left side, opposite to the side of the right column from which it came down. The direction of rotation of the basket is then inverted in order to take it back in position below the two columns and to support the right column, while another product comes down from the left column for the next release from the right side of the basket when it will rotate 90° clockwise. Therefore, prior art devices must include a mechanism for inverting the direction of rotation of the basket, which oscillates along an arc of about 180° centered on the vertical.

Furthermore, the basket always occupies a portion of the width of the product drop channel, even when it reaches the vertical position. This implies that the maximum product diameter which can be managed by said device depends on the distance from the channel wall to the edge of the basket in the vertical position. Therefore, the width of the drop channel is not completely exploited in this way.

In practice, in order to exploit the depth of the device, not only a single product at a time but a whole row of products horizontally aligned one behind the other comes down into the basket. The sequential release of the products making up said row (usually 2 or 3) is achieved by providing a series of horizontal projections of increasing width on the wall of the drop channel along the depth of the device. By carrying out the above-mentioned 90° rotation in more steps, at each stop of the basket there is only one product which has sufficient room, between the basket edge and the projection positioned by that product, to roll out of the basket and thus be released, whereas those behind it in the row are retained by the respective wider projections. Once the drop channel width is established, the limit to the number of products making up a row is given by the fact that the widest projection must not be wider than the basket in the vertical position, otherwise said projection would reduce the drop width when the product is released from the other side.

Therefore, the object of the present invention is to provide a device which overcomes the above-mentioned drawbacks.

This object is achieved by means of a device having the characteristics cited in claim 1.

A first fundamental advantage of the present device comes from the unidirectional rotation of the basket, which allows to simplify the mechanical and electrical control of the sales in multiple rows. The resulting device is therefore cheaper and more reliable.

A second advantage of the device according to the invention is the exploitation of the whole width of the drop channel, whereby within the same transverse space it is possible to manage products of greater diameter and/or longer rows. Therefore, the device capacity and the diameter range it can manage are increased without requiring changes.

These and other advantages and characteristics of the device according to the present invention will be apparent to those skilled in the art from the following detailed description of an embodiment thereof referring to the annexed drawings wherein.

Figure 1:
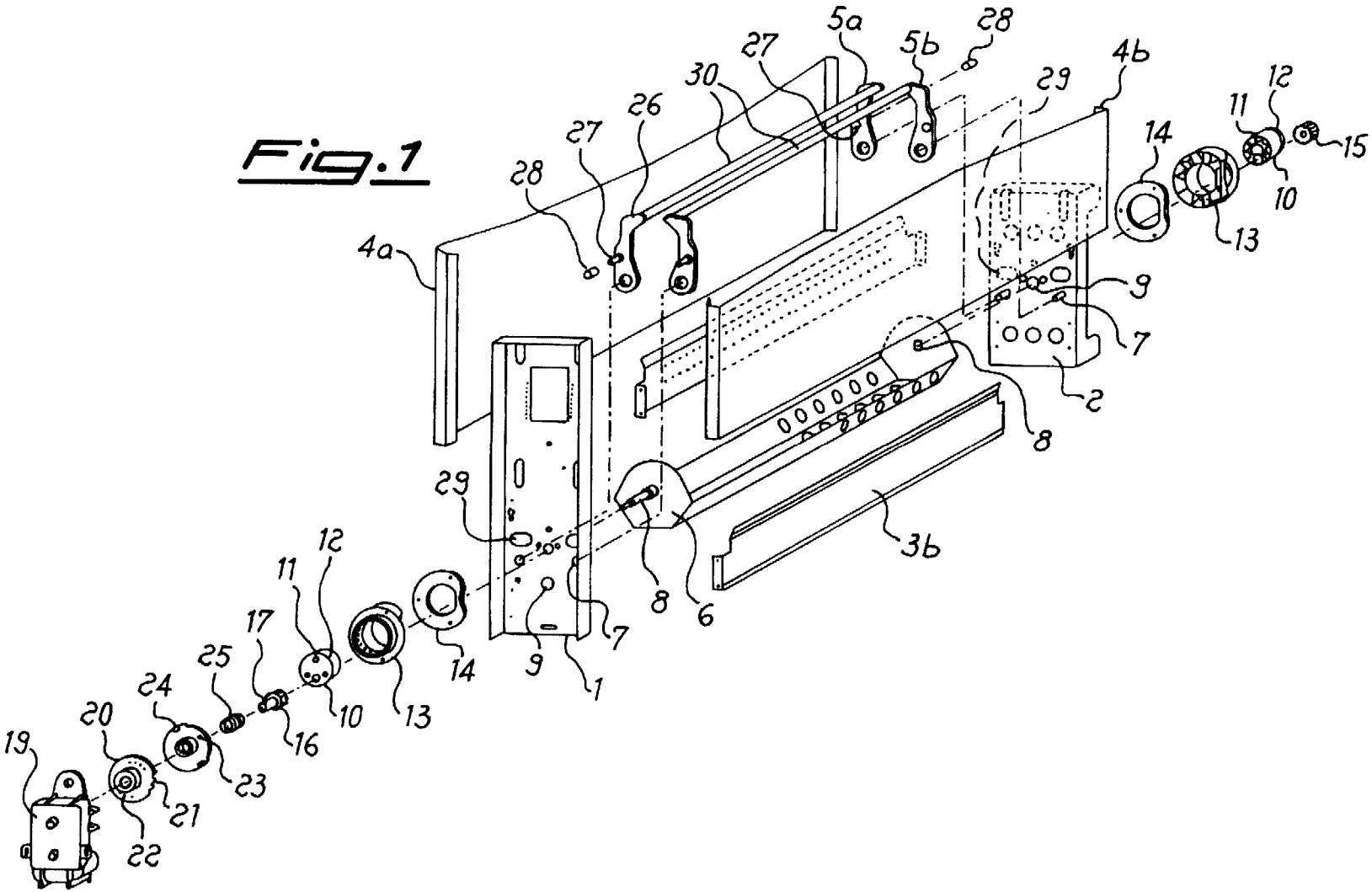
FIG. 1 is a perspective exploded view of a device according to the present invention.

Referring to FIG.1, there is seen that a device according to the present invention conventionally includes a structure for containing the products on sale, inside which structure the members for selecting and releasing the products are positioned, while the components for controlling and driving said elements are placed outside.

The containing structure is made up of a front plate 1 and a rear plate 2, mutually connected in the lower portion thereof by a left flank 3*a* and a right flank 3*b* which form the drop channel mouth. In the upper portion, two side walls 4*a*, 4*b* (the right one 4*b* shown in phantom) are positioned to contain the stacked products as mentioned above. Said walls are secured to plates 1 and 2 through perforated supports (not shown) which assure their equal distance from the vertical mid plane of the device and allow the variation of their mutual distance according to the diameter of the products, as it will be better explained further on. Obviously, the walls are spaced while always keeping them at equal distance from the mid plane.

The members for selecting and releasing the products consist in a pair of rocker levers 5*a*, 5*b* for supporting and alternately letting down the products in an underlying revolving basket 6. Each rocker is pivoted at the front and rear to plates 1 and 2, respectively, by means of pivots 7 integral with said plates. On the contrary, basket 6 is provided with central pivots 8, at the front and rear, which go across plates 1 and 2 through corresponding passage holes 9.

The components for controlling and driving the above members include a cylindrical sleeve 10 provided with bores 11 for fixing it to the plate and with a projecting edge rim 12 acting as a blocking ring for a crown wheel 13 inside which said sleeve 10 is inserted. A cam 14, whose profile will be described in detail later on, is mounted on crown 13 on the side towards the plate. This series of components is symmetrically mounted on pivots 8 of basket 6 both at the front and rear.

Figure 2:
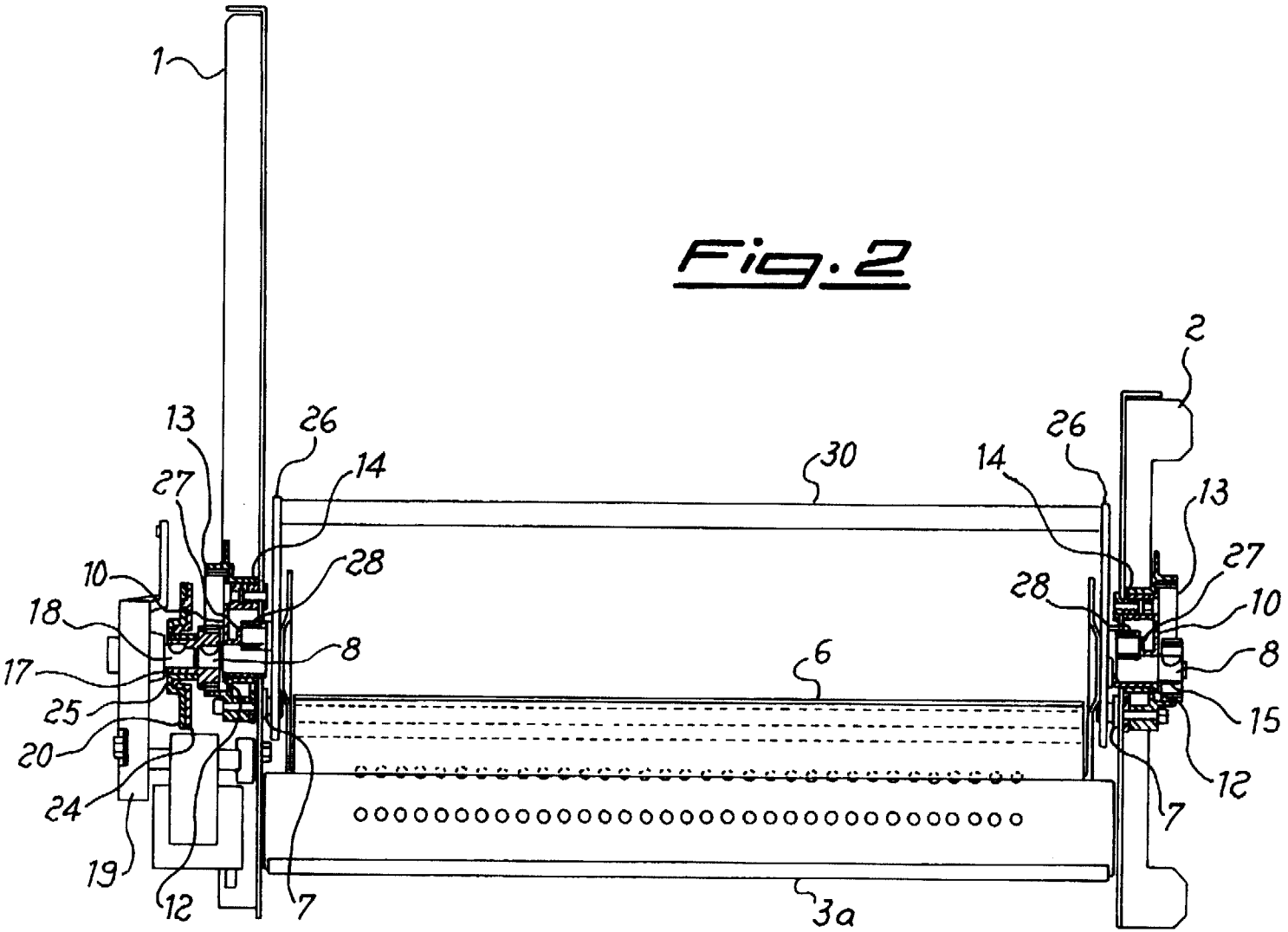
FIG. 2 is a longitudinal sectional view of the assembled device of FIG. 1.

The section of FIG. 2 clearly shows how sleeve 10 acts as a journal box for pivot 8 and as a pivot for crown wheel 13. This section also shows how the rear pivot 8 is blocked by means of a rear pinion 15 secured thereon by means of a key and engaging crown 13. A similar front pinion 16 is keyed also on the front pivot 8, but it is provided with a forward extending hub 17 which is keyed onto the output shaft 18 of a motor reducer 19 mounted on plate 1 by means of brackets and spacers. Therefore, pinion 16 acts as a mechanical joint between motor reducer 19 and the rest of the device, while basket 6 acts as a drive shaft to transmit the motion to the rear pinion 15.

A disc 20 provided with a series of peripheral notches 21 suitable to operate a switch mounted on plate 1 (not shown) to control the motor reducer stopping is fixed on the outside of hub 17 of pinion 16. In this way, basket 6 is stopped at the desired positions during its rotation in order to carry out the sequenced release of a row of products as previously explained. The number of notches 21 is obviously equal to the maximum number of stops intended for basket 6. Disc 20 is also provided with two opposite series of holes 22 wherein a pair of pins 23 making part of a covering disc 24 pushed against disc 20 by a spring 25 are inserted from the rear. In order to reduce the number of stops according to the need, it is possible to cover one or more notches 21 by changing the position of disc 24 with respect to disc 20.

It should be noted that the gear ratio between pinions 15, 16 and crowns 13 is equal to 0.5, whereby a complete revolution of basket 6 secured to the pinions corresponds to half revolution of crowns 13 and of cams 14 secured thereto.

Each end arm 26 of the rockers is provided with a pin 27, on which a needle bearing 28 is mounted, passing through a slot 29 in the plate and forming the follower which follows the profile of cam 14. Thanks to the position of pivot 7 external with respect to the supporting bar 30 on which the weight of the product column abuts, the rocker is always pushed inwards. In this way, the follower follows the cam profile with no need for a return spring or a guide groove.

Figure 3:
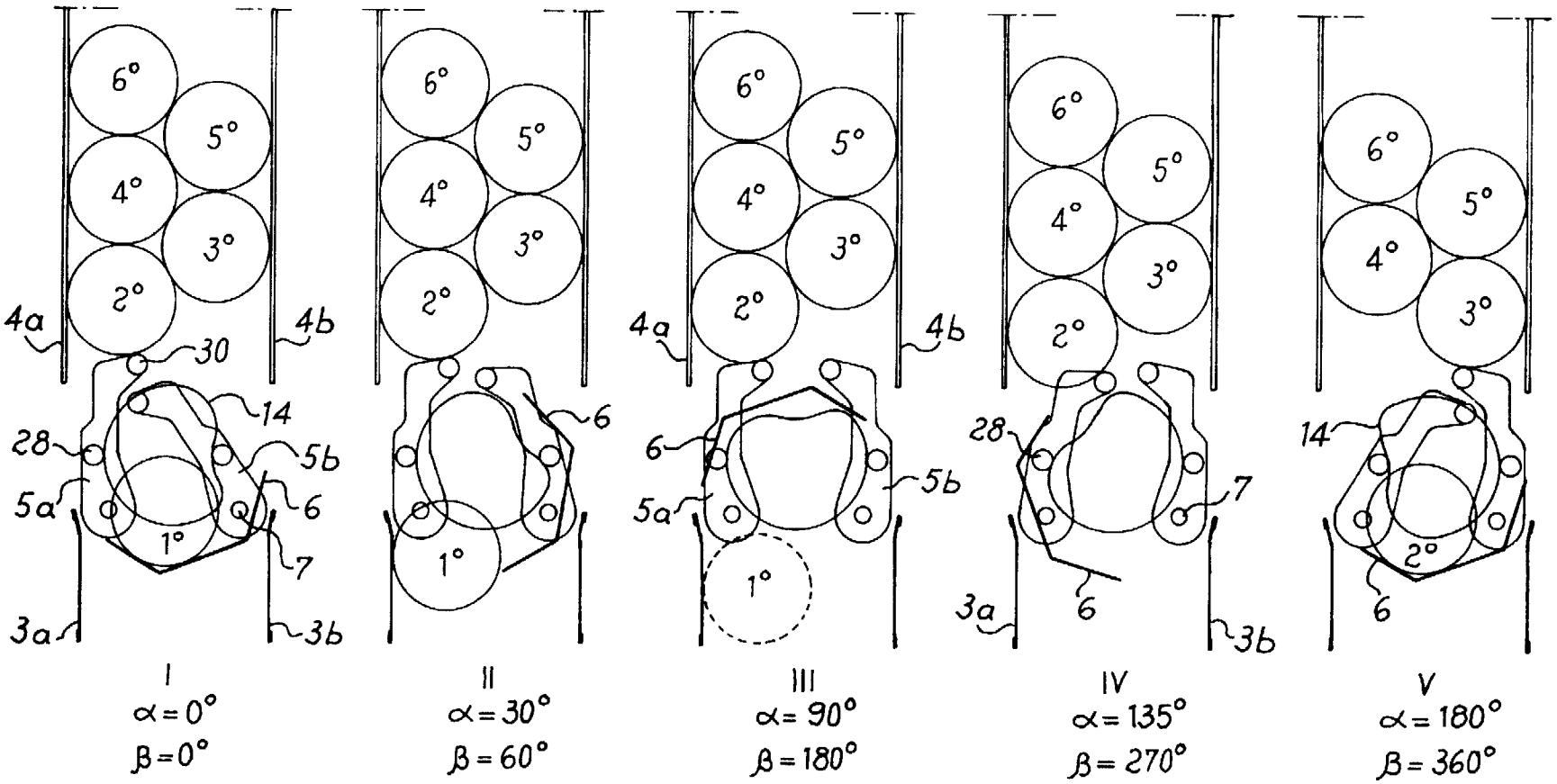
FIG. 3 is a schematic illustration of the operating sequence of the device.

The operating sequence of the device according to the present invention is now described with reference to FIG. 3, which is a schematic front view thereof. In the starting position 1, basket 6 is arranged almost horizontally and contains a $1^{st}$ product. The left rocker 5*a* is in a vertical position since the corresponding bearing 28 abuts on cam 14 in the portion of greatest diameter, whereas the right rocker 5*b* has the maximum inclination inwards because the corresponding bearing 28 abuts on cam 14 in the position of smallest diameter. The two columns of products contained between walls 4*a* and 4*b* are supported by the left rocker 5*a*, on whose bar 30 the $2_{nd}$ product positioned at the base of the left column abuts. The angle of rotation of cam 14 is indicated in the drawing by α, while that of the basket is indicated by β.

When motor reducer 19 is activated by the vending machine controller, its shaft 18 rotates pinion 16, counter clockwise in the case illustrated, and basket 6 and pinion 15 therewith, as previously mentioned. The pinions engage with the crowns 13 bearing the cams 14 which rotate at half the speed of basket 6, as explained above.

After the first 30° of rotation of cam 14 the device has reached position 11, in which the right rocker 5*b* has almost completed the upstroke towards the vertical position while the left one 5*a* is still in said position. In contrast, basket 6 has rotated 60° and also has almost reached the vertical position. The $1_{st}$ product contained therein has rolled over the edge but is still hold by the left flank 3*a*.

Through the following 60° rotation of cam 14 the device reaches position III, in which both rockers are still in the vertical position because the respective bearings 28 roll along the greatest diameter portion of cam 14. Basket 6 has globally rotated for 180° and therefore is now overturned with respect to the starting position. The $1_{st}$ product contained therein has been released through the drop channel.

In the following 45° rotation of cam 14 the device reaches position IV, in which the bearing 28 of the left rocker 5*a* is at the beginning of the portion which leads it to the smallest diameter of cam 14. Therefore, the corresponding rocker 5*a* starts to incline inwards, while the right rocker 5*b* is still in the vertical position and basket 6 has completed ¾ of revolution by now.

During the last 45° rotation of cam 14 the device reaches position V, in which the inclination of the left rocker 5*a* inwards has taken its bar 30 to a distance from the left wall 4*a* greater than the maximum diameter of the $2^{nd}$ product which therefore has come down in basket 6, which has completed its revolution in the meanwhile. The two columns of products are now supported by the right rocker 5*b*, still vertical, on whose bar 30 the $3^{rd}$ product positioned at the base of the right column abuts.

At the end of the operating cycle basket 6 has come back to the starting position, whereas cam 14 is in a secular position, since it has made only ½ revolution. The description given above is also valid for the other ½ revolution of cam 14, requiring only to swap terms "left" and "right". Therefore, there is the apparent advantage of having a basket 6 which makes a 360° rotation at each cycle thus discharging the product always from the same side, regardless of the column from which the product comes, and fully exploiting the distance between flanks 3*a* and 3*b*.

This feature is particularly useful to increase the number of products contained in the machine, by increasing the device depth while keeping the width constant. As explained in the introduction, the $1^{st}$ product usually represents a first row of aligned products coming down all together in basket 6. During the rotation between position 11 and position III the basket makes a number of stops equal to the number of products to be sequentially released, according to the notches 21 on disc 20. The product falling always from the same side allows to arrange a higher number of increasing width projections along one flank only (the left one 3*a* in this case). In fact, it is sufficient that the widest projection is spaced from the opposite flank more than the maximum diameter of the product. In this way it is possible to arrange 4–5 products in a row, and for this reason it is important that the basket be pivoted and driven into rotation at both ends.

The complete exploitation of the drop channel width also allows to reach a wider range of the maximum diameter of the products manageable by the device. It is sufficient to adjust the distance between walls 4*a* and 4*b* in order to be able to introduce products whose diameter may range, for example, between 53 and 95 mm. It should also be noted that the direct connection, through pinion 16, between motor reducer 19, disc 20 and basket 6 allows a direct control of the sequenced release positions which are not affected by possible plays present in the mechanism.

It is clear that the above-described and illustrated embodiment of the device according to the invention is just an example susceptible of various modifications. For example, the components for transmitting the motion may be replaced by other mechanically equivalent ones, as long as the gear ratio between cams 14 and basket 6 is maintained.

I claim:

1. A device for releasing products in a vending machine, including a structure containing two staggered columns of the products comprising a front plate (1) and a rear plate (2) to which two flanks (3*a*, 3*b*) and two walls (4*a*, 4*b*) are secured, a pair of rocker levers (5*a*, 5*b*) and a revolving basket (6) being rotatably mounted inside said structure for alternately supporting the two staggered columns forming the stack of products and for releasing the products, and components for controlling and driving said rockers (5*a*, 5*b*) and said basket (6) positioned outside said structure, characterized in that said driving components impart a unidirectional revolving motion to the basket (6) and said controlling components of the rockers (5*a*, 5*b*) comprising in a pair of cams (14) which rotate at half the revolving speed of the basket (6).

2. A device according to claim 1, wherein each rocker (5*a*, 5*b*), by alternately oscillating towards a center of the device, reaches a distance from the corresponding wall (4*a*, 4*b*) greater than a maximum diameter of the product which thus comes down into the basket (6) from the base of the stack, while the other rocker supports the rest of the stack.

3. A device according to claim 1, wherein the walls (4*a*, 4*b*) are secured to the front and rear plates (1,2) in a position at equal distance from a vertical mid plane of the device and in such a way as to be able to adjust their mutual distance between one and another while keeping the said equal distance.

4. A device according to claim 2, wherein the walls (4*a*, 4*b*) are secured to the front and rear plates (1,2) in a position at equal distance from a vertical mid plane of the device and in such a way as to be able to adjust their mutual distance between one and another while keeping said equal distance.

5. A device according to claim 1 further comprising: a motor reducer, an output shaft, and a disc which defines stops of said motor reducer, said motor reducer provides revolving motion to the device and is directly integral with the basket and said disc.

* * * * *